United States Patent [19]

Nystrom

[11] 4,048,878

[45] Sept. 20, 1977

[54] SLIP-TYPE PLIERS TOOL

[75] Inventor: Walter Albert Nystrom, Arlington Heights, Ill.

[73] Assignee: Dresser Industries, Inc., Dallas, Tex.

[21] Appl. No.: 673,575

[22] Filed: Apr. 5, 1976

[51] Int. Cl.[2] ..... B25B 7/04

[52] U.S. Cl. ..... 81/409

[58] Field of Search ..... 81/385–394, 81/405–414

[56] References Cited

U.S. PATENT DOCUMENTS

| | | | |
|---|---|---|---|
| 844,886 | 2/1907 | Morris | 81/407 |
| 2,784,629 | 3/1957 | Adair | 81/409 |
| 2,811,068 | 10/1957 | Pepperdine | 81/409 |

*Primary Examiner*—James L. Jones, Jr.

*Attorney, Agent, or Firm*—Roy L. Van Winkle; John N. Hazelwood

[57] ABSTRACT

The improved slip-type pliers tool includes a pair of jaw members that are arranged to permit pivotal movement therebetween. Mutually engageable surfaces are provided on the jaw members to limit the pivotal movement when the tool is in the closed position, to a position wherein the engaging surfaces on the jaw members are in generally parallel, spaced relationship. The tool also includes a ratchet dog located in a slot in one jaw member. The jaw member having the slot is provided with a series of teeth that mate with teeth provided on the ratchet dog. A cam located in the slot and connected to one of the jaw members is eccentric so that pivotal movement toward the open position of the tool causes the ratchet dog to become disengaged from the teeth on the jaw member permitting sliding adjustment of one jaw member relative to the other to open and close the space between the generally parallel engaging surfaces.

1 Claim, 6 Drawing Figures

SLIP-TYPE PLIERS TOOL

BACKGROUND OF THE INVENTION

This invention relates generally to improved slip-type pliers tools that are frequently referred to as "water pump pliers". More particularly, but not by way of limitation, this invention relates to an improved slip-type pliers tool that is retained, when in the closed position of the tool, with the engaging surfaces thereon in a generally parallel, spaced relationship and one in which the space between the engaging surfaces on the tool can be adjusted in relatively small increments.

U.S. Pat. No. 3,854,351 issued Dec. 17, 1974, to Ralph Martin, illustrated in its background discussion, a typical, generally available water pump pliers. In that type of pliers, the incremental spacing between the engaging surfaces of the pliers is controlled by the position of an arcuate lug located in a selected one of a series of concentric arcuate grooves formed in the opposite jaw member.

Another type of pliers that is available, is manufactured by a German company under the trademark "Olin". The Olin pliers has a slot formed in one of the jaw members in which a toothed, spring-loaded ratchet dog is disposed. One edge of the slot is formed with mating teeth, and pivotal movement of the pliers toward the open position moves the ratchet out of engagement with the teeth permitting sliding movement to incrementally adjust the space between the engaging surfaces of the pliers. Movement of the ratchet dog is controlled by a coil spring that encircles the pivot pin of the pliers.

Both of the foregoing types of pliers have been accepted commercially and both operate reasonably satisfactorily. However, pivotal movement of the jaw members toward the closed position results in a non-parallel relationship between the engaging surfaces. When utilizing the pliers to loosen nuts or bolts having engaging surfaces disposed in parallel planes, such pliers can cause damage to the corners of such fasteners which may result in such fasteners being unserviceable.

An object of this invention is to provide an improved, slip-type pliers tool that cannot be closed beyond the position wherein the engaging surfaces thereon are in generally parallel, spaced relationship.

Another object of the invention is to provide an improved slip-type pliers tool wherein the incremental spacing between the engaging surfaces can be varied in very small, pre-selected increments.

SUMMARY OF THE INVENTION

This invention provides an improved slip-type pliers tool comprising in combination; first and second jaw members, each of the jaw members including a handle portion and a jaw head portion having an engaging surface thereon. Means are provided for pivotally connecting the jaw members between the handle portions and head portions. Means are also provided for permitting and preventing relatively sliding movement between the jaw members. Abutment means on the jaw members are mutually engageable for limiting the pivotal movement of the engaging surfaces relatively toward each other to a position wherein the engaging surfaces are located in generally parallel, spaced relationship.

The foregoing and additional objects and advantages will become more apparent as the following detailed description is read in conjunction with the accompanying drawing.

DETAILED DESCRIPTION OF THE PREFERRED EMBODIMENT

Figure 1:
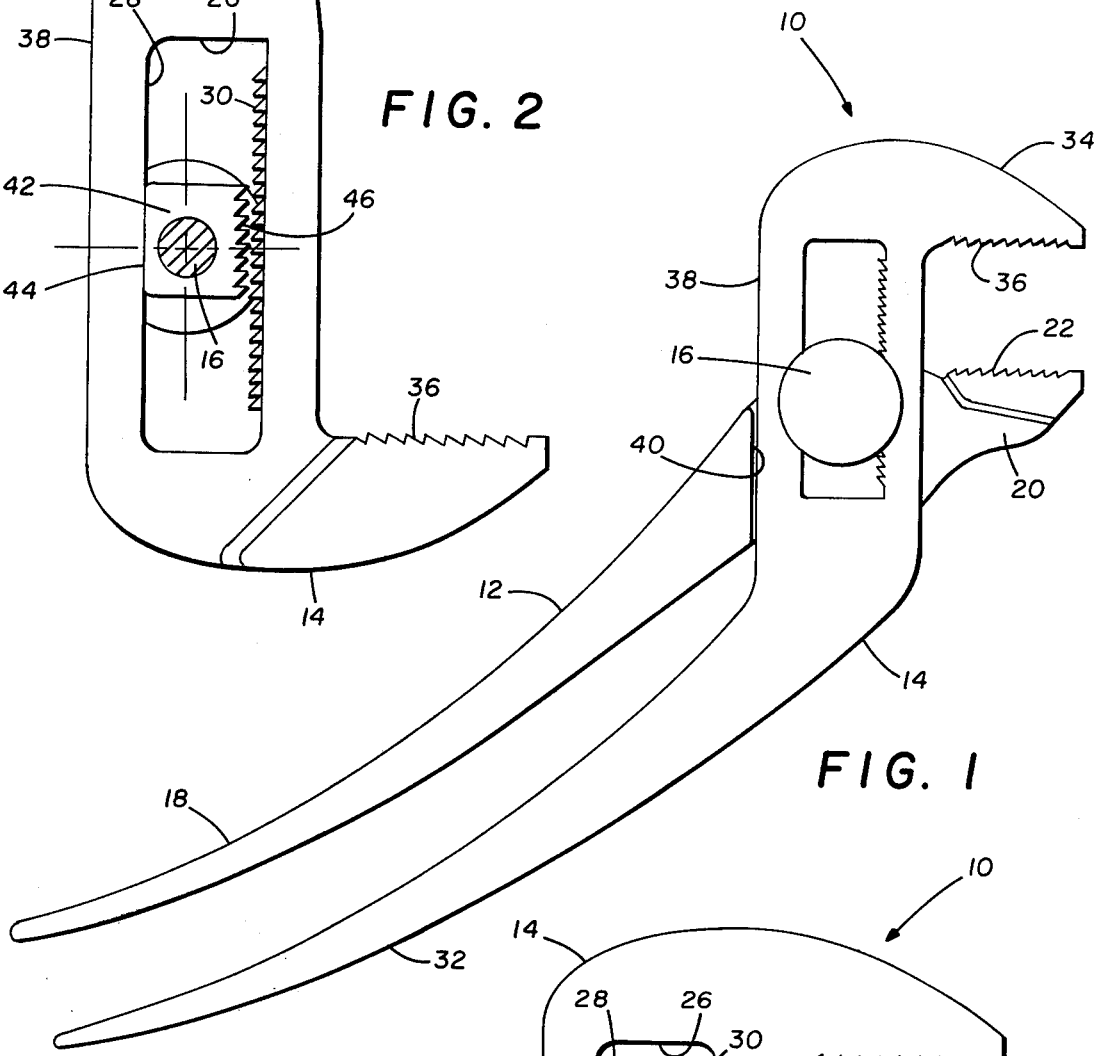
FIG. 1 is an elevation view of the improved sliptype pliers tool that is manufactured in accordance with the invention.

Referring to the drawing and FIG. 1 in particular, shown therein and generally designated by the reference character 10, is a slip-type pliers constructed in accordance with the invention. The pliers 10 includes a first jaw member 12 and a second jaw member 14 that are pivotally connected by a pivot pin 16. The pin 16 includes four large portions on the outside of jaw members 12 and 14 to prevent separation on the jaw members.

Figure 3:
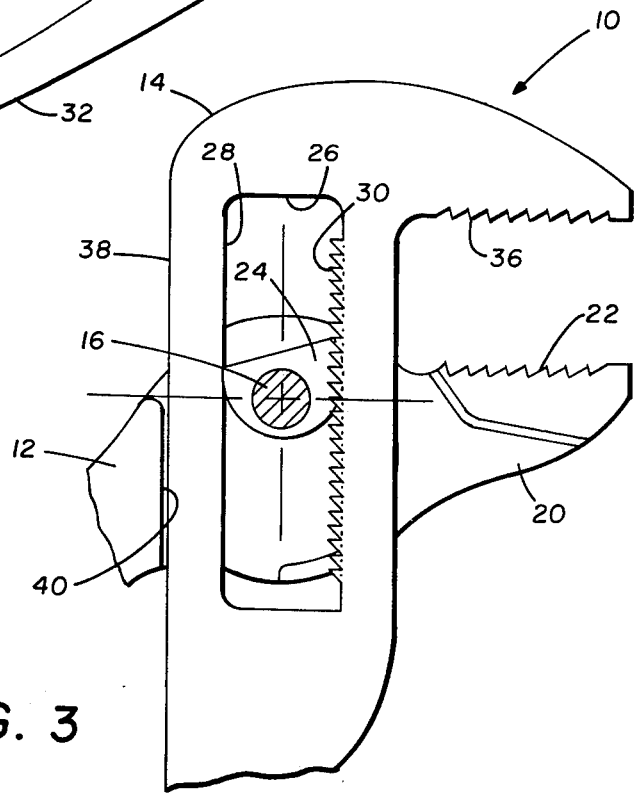
FIG. 3 is a partial, enlarged view of a portion of the tool of FIG. 1, illustrating the arrangement of the cam therein.

The first jaw member 12 includes a handle portion 18 and a jaw head portion 20. The jaw head portion 20 has an engaging surface 22 thereon. As may be seen more clearly in FIG. 3, the jaw member 12 also includes a cam 24 that is eccentric with respect to the pivot pin 16. The cam 24 may be formed as a portion of the jaw member 12 or may be separately formed and connected for movement therewith.

The cam 24 extends into and rides in a slot 26 formed in jaw member 14. A surface 28 on the slot 26 is smooth, while the opposite surface thereof is partially smooth to receive the cam 24 and partially formed with a plurality of spaced ratchet teeth 30.

In addition to the slot 26, the jaw member 14 also includes a handle portion 32 and a head portion 34. The head portion 34 is provided with an engaging surface 36. As illustrated, the engaging surfaces 22 and 36 are serrated, but it will, of course, be understood that they may be smooth surfaces if desired. In either event, the surfaces 22 and 36 are, when the pliers 10 are disposed in the closed position as illustrated in FIG. 1, in generally parallel, spaced relationship. The surfaces 22 and 36 are retained in this position by the engagement of an edge surface 38 that is disposed between the jaw head portion 34 and the handle portion 32 of the jaw member 14 with a shoulder 40 that is formed on the handle portion 18 of the jaw member 12.

Figure 2:
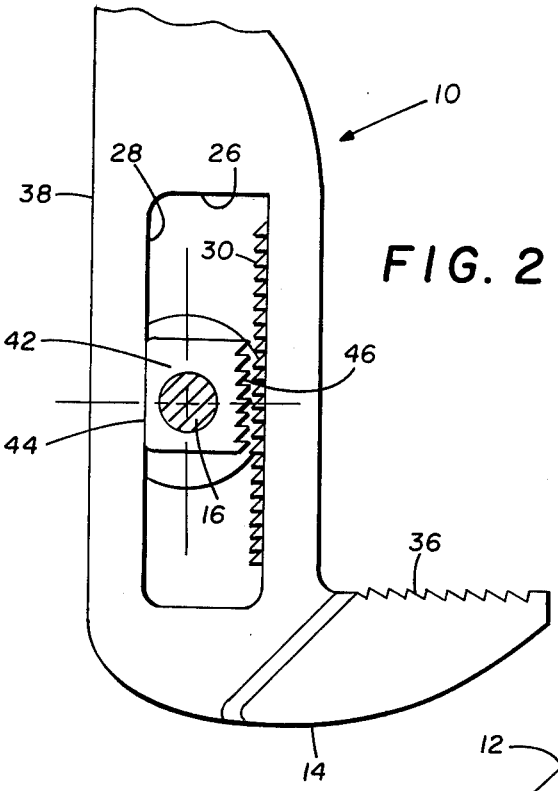
FIG. 2 is a partial, enlarged view of a portion of the tool of FIG. 1, illustrating the construction of the slot and ratchet dog.

Referring to FIG. 2, it can be seen that a generally rectangular ratchet dog 42 is also disposed in the slot 26 of the jaw member 14. The ratchet dog 42 includes a smooth surface 44 that is adapted to slidingly engage the smooth surface 28 on the slot 26 at times. The opposite surface of the ratchet dog 42 is provided with a plurality of teeth 46 that are constructed to matingly engage the teeth 30 in the slot 26. The pivot pin 16 extends through the ratchet dog 42 and is rotatable relative thereto for reasons that will become more apparent hereinafter. It should be noted that the teeth 46 and the teeth 30 are relatively small and closely spaced so that the gap between the surfaces 22 and 36 can be adjusted in very small, pre-selected increments.

OPERATION

Figure 4:
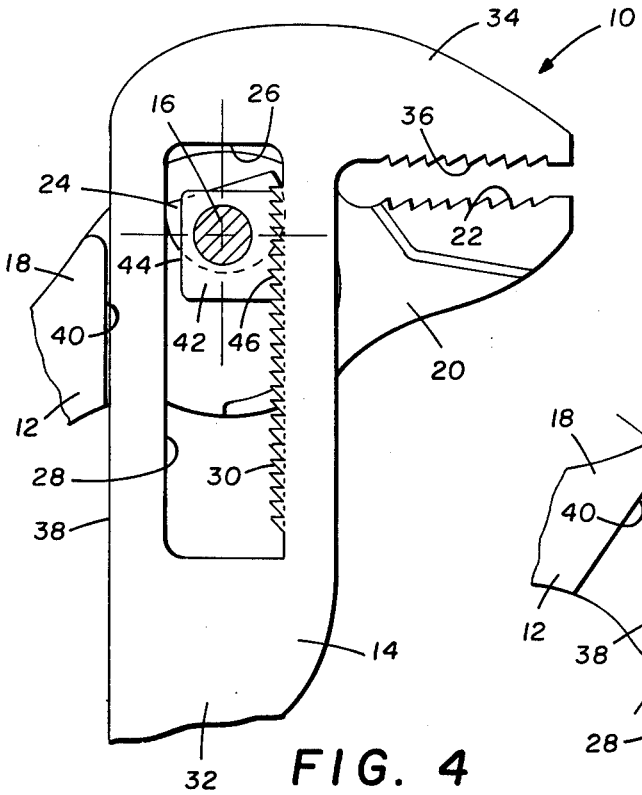
FIGS. 4, 5 and 6 are operational views illustrating the elements of the tool in the positions they occupy during adjustment.
Figure 5:
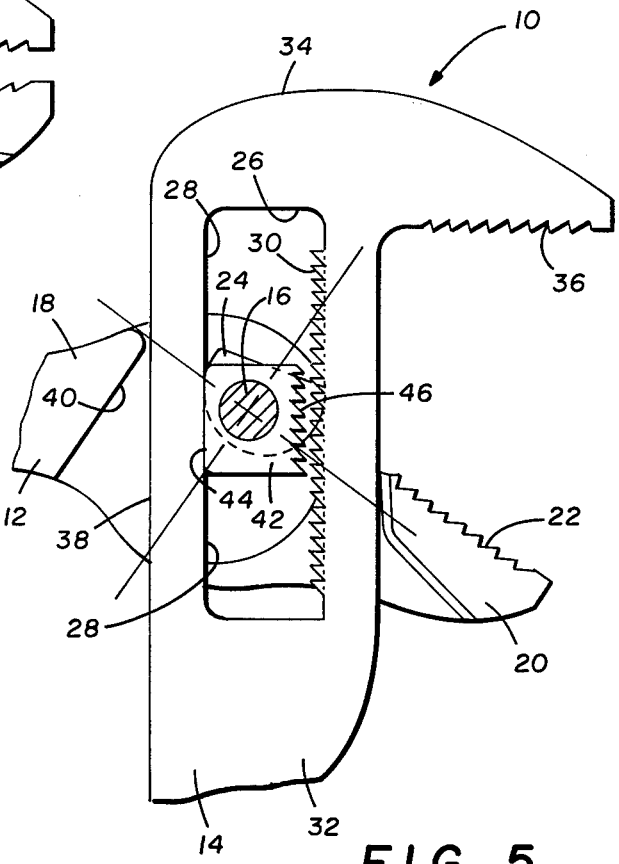
Figure 6:
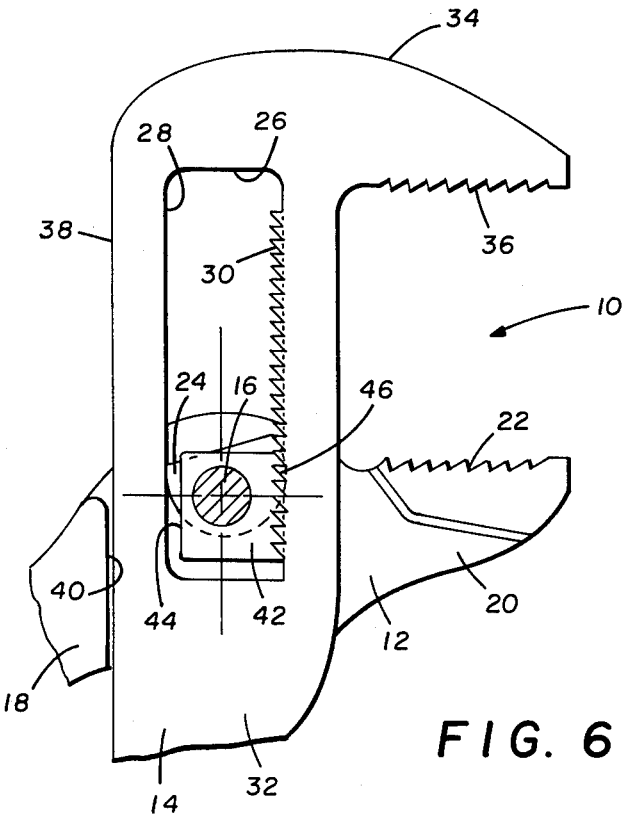

The operation of pliers 10 is illustrated in FIGS. 4–6. As shown in FIG. 4, the pliers 10 is in the closed position with the engaging surfaces 22 and 36 in relatively close proximity. In that position, it will be noted that those surfaces are retained in a generally parallel, spaced relationship by the engagement of the shoulder 40 on the jaw member 12 with the surface 38 on the jaw member 14. The space between the surfaces 22 and 36 cannot change because the cam 24 is rotated to a position wherein the ratchet dog 42 is moved to the right, holding the teeth 46 thereon in mating engagement with the teeth 30 in the slot 26.

As shown in FIG. 5, jaw members 12 and 14 of the pliers 10 have been rotated about the pivot pin 16. The eccentricity of the cam 24 moves the pivot pin 16 relatively to the left carrying the ratchet dog 42 therewith until the smooth surface 44 on the ratchet dog engages the smooth surface 28 in the slot 26. In this position, the teeth 46 on the ratchet dog 42 are out of engagement with the teeth 30 in the slot 26, permitting sliding movement of the jaw member 12 relative to the jaw member 14. It will be noted that the engaging surfaces 22 and 36 are not in a parallel relationship when the pliers 10 is in the open position as illustrated in FIG. 5.

In FIG. 6, the pliers 10 has been returned to the closed position, and it can be seen that the engaging surfaces 22 and 36 are again in parallel relationship. The surfaces are retained in that position by the engagement of shoulder 40 on the jaw member 12 with the surface 38 on the jaw member 14, as previously mentioned.

It will also be noted in FIG. 6 that the space or gap between the engaging surfaces 22 and 36 is considerably larger than that shown in FIG. 4. After movement of the elements of the pliers 10 to the position shown in FIG. 5, the jaw member 12 has been moved downwardly in the slot 26 relative to the jaw member 14 to provide the wider space. As previously mentioned in connection with FIG. 4, the jaw member 12 has been pivoted relative to the jaw member 14 so that the eccentricity of the cam 24 again moves the ratchet dog 42 to the right, bringing the teeth 44 thereon into mating engagement with the teeth 30 to retain the pre-selected space between the engaging surfaces 22 and 36.

From the foregoing, it will be appreciated that the pliers 10 described herein is an improvement over the arc-type or "water pump pliers" that are generally known. It will be appreciated that the engaging surfaces 22 and 36, when the pliers is in the closed position, are always in generally parallel spaced relationship and that the space therebetween can be varied in very small pre-selected increments.

The foregoing detailed description has been presented by way of example only, and it will be understood that many modifications and changes can be made thereto without departing from the spirit and scope of the invention.

The embodiments of the invention in which an exclusive property or privilege is claimed are defined as follows:

1. An improved slip-type pliers tool comprising in combination:

a first jaw member having a handle portion, a jaw head portion including an engaging surface, a shoulder on a side surface thereof, a cam portion projecting from said side surface spaced from said shoulder and a pivot hole extending through said jaw member and cam portion and eccentric to said cam portion;

a second jaw member having a handle portion, a jaw head portion including an engaging surface, an internal slot extending therethrough and receiving said cam portion, a toothed edge surface in said slot, and an exterior edge surface arranged to engage said shoulder;

a pivot pin having a head and a reduced body portion located in said hole and extending through said slot; a pivot pin retaining member connected to said body portion and located to prevent separation of said jaw members while permitting relative pivotal movement therebetween;

a ratchet dog movably disposed in said slot, said dog being located on said pivot pin and having a toothed edge arranged to mate with the toothed edge surface of said slot and movable by said pivot pin into and out of engagement with said toothed edge surface; and, said jaw members being relatively pivotal on said pivot pin between an open position of said tool wherein said ratchet dog and toothed edge surface are out of engagement and the distance between said engaging surfaces can be varied by sliding movement of said jaw members and a closed or engaging position wherein said ratchet is in engagement with said toothed edge portion preventing sliding adjustment and the shoulder on said first jaw member is in engagement with the exterior edge surface on said second jaw member limiting the pivotal movement of said jaw members and retaining said engaging surfaces in a generally parallel, spaced relationship.

* * * * *